United States Patent [19]

Shu

[11] Patent Number: 4,635,927

[45] Date of Patent: Jan. 13, 1987

[54] LOW POWER TREADMILL

[75] Inventor: Stephen K. Shu, Fountain Valley, Calif.

[73] Assignee: Del Mar Avionics, Irvine, Calif.

[21] Appl. No.: 707,816

[22] Filed: Mar. 4, 1985

[51] Int. Cl.[4] ..... A63B 23/06

[52] U.S. Cl. ..... 272/96; 318/341; 318/376

[58] Field of Search ..... 272/69, 73, 129, DIG. 6; 318/341, 376

[56] References Cited

U.S. PATENT DOCUMENTS

| | | | |
|---|---|---|---|
| 3,602,502 | 8/1971 | Hampl | 272/69 |
| 3,737,163 | 6/1973 | Sumrall | 272/69 |
| 4,330,742 | 5/1982 | Reimers | 318/376 |
| 4,513,231 | 4/1985 | Kuno et al. | 318/341 |

*Primary Examiner*—Leo P. Picard

[57] ABSTRACT

The specification discloses an exercise treadmill for diagnostic and therapeutic purposes incorporating an improved drive and control system. High efficiency at low rpm is effectuated through the use of a DC motor which maintains the belt speed constant by varying the width of the applied pulse duration as a function of load. Additional load buffering between the belt and motor is effectuated by a double flywheel configuration.

8 Claims, 2 Drawing Figures

LOW POWER TREADMILL

BACKGROUND OF THE INVENTION

1. Field of the Invention

This invention relates to physiological stress testing devices for medical diagnostics, and particularily to devices of the type employing a motor powered moving surface commonly known as a treadmill.

2. Description of a Related Art

Exercise treadmills have been used extensively as diagnostic and therapeutic devices. They are particularly well suited to the evaluation and study of heart and lung diseases in that they provide a continuous and programmable level of activity. Although electrocardiograms taken from resting patients are useful for some types of physiological defects, there are many abnormalities which will go undetected unless the patient is subjected to a certain threshold level of energy output. The ability of the treadmill to provide an accurate and predictable level of continuous exercise—representing a constant workload—graded at various time intervals, has led to its widespread use as aid in medical diagnosis and patient evaluation.

Traditional treadmills utilize an induction motor which is speed controlled by a triac or other AC switching device which varies the conduction angle to provide sufficient power to maintain the desired velocity. At maximum speeds, i.e., when the conduction angle approaches 180° of each half cycle, the motor operates efficiently, and the ratio of power supplied to the belt to the input power is maximized. When the same motor is operated at a slow belt speed however, the conduction angle is reduced to a small fraction of the full cycle. Because of the combined effect of the reduced back emf and the short duration of the applied power, the motor current flows in high amplitude, short duration pulses. The $I^2R$ losses are thus multiplied and the overall efficiency of the system is materially reduced. For effective operation with reasonably sized motors, a 220 volt source is required.

It is thus a primary objective of the present invention to provide a electronic system for operating a treadmill over a range of velocities utilizing a standard 110 volt power source.

The problem of operating at low velocities is compounded by the intermittent nature of the load. As the patients foot propels him forward to maintain his relative velocity with respect to the belt, the load increases sharply and then drops abruptly to zero—the effect being to introduce an additional variable in the form of a reoccurring impulse load. It is thus a further object of the present invention to provide a buffer between the motor and belt which will smooth out the load reflected to the motor.

A third and interrelated aspect of the present invention is an electronic braking system which abruptly stops the motor in the event of an emergency.

Other objects and advantages of the present invention will be obvious from the detailed description of a preferred embodiment given herein below.

SUMMARY OF THE INVENTION

The aforementioned objectives are realized by a preferred embodiment of the present invention which comprises a power supply for converting a 110 volt 60 cps source to DC, a detector network for sensing the motor back emf, a switching element for controlling the duration of the DC pulse power applied to the motor, and a feedback loop for controlling the duration of the gating signal applied to the switching element in inverse proportion to the back emf detected by the detector network. The output of the switching element is filtered to produce a DC level having an amplitude which is sufficient to maintain the motor velocity at the desired speed. Load impulse coupling between the belt and motor is minimized by a dual flywheel arrangement which functions to buffer and smooth out abrupt load changes caused by the action of the runner on the moving belt. In addition, the invention includes a dynamic braking circuit which rapidly decelerates the belt in an emergency.

DETAILED DESCRIPTION OF A PREFERRED EMBODIMENT OF THE INVENTION

Figure 1:
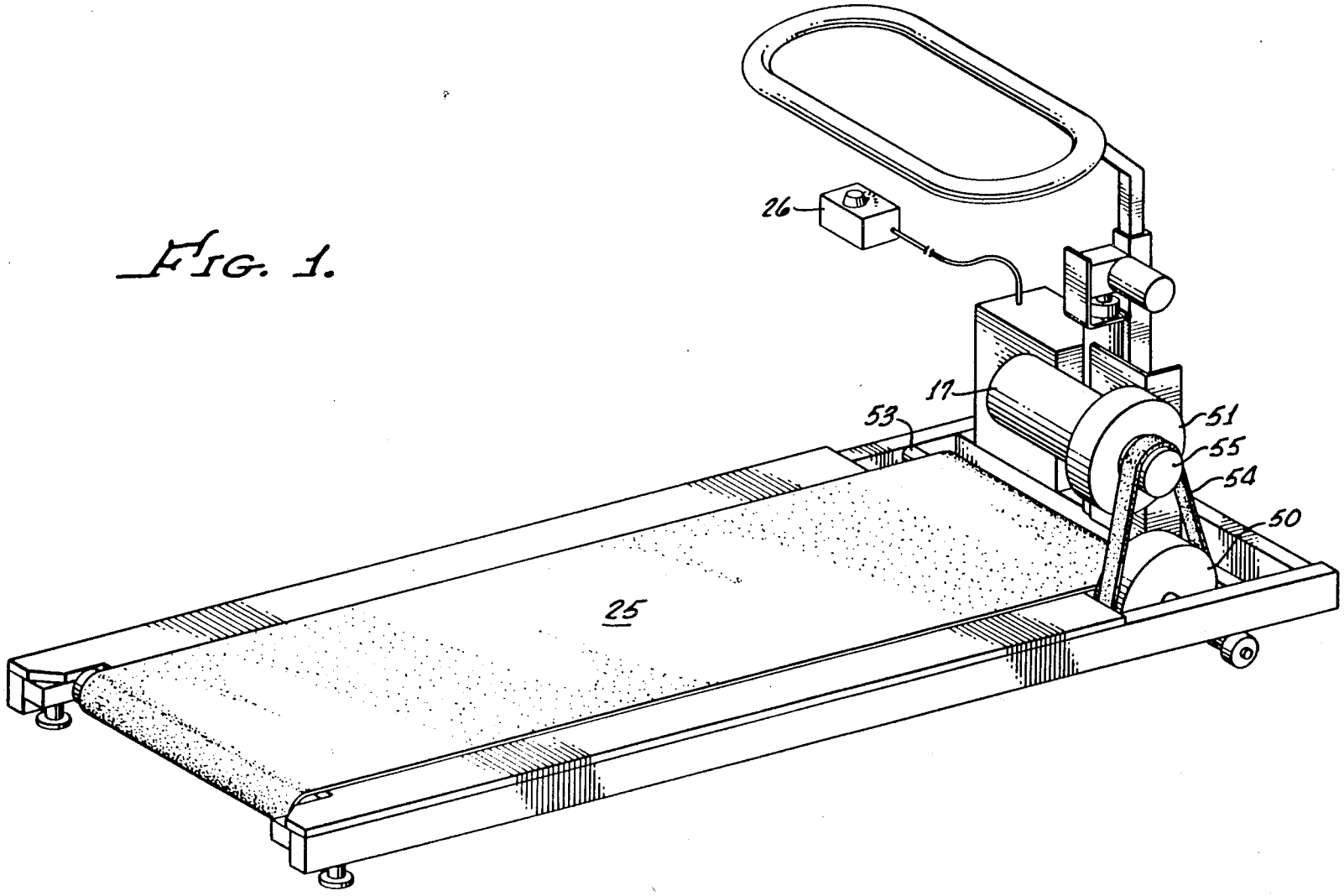
FIG. 1 shows a perspective view of the low power treadmill.
Figure 2:
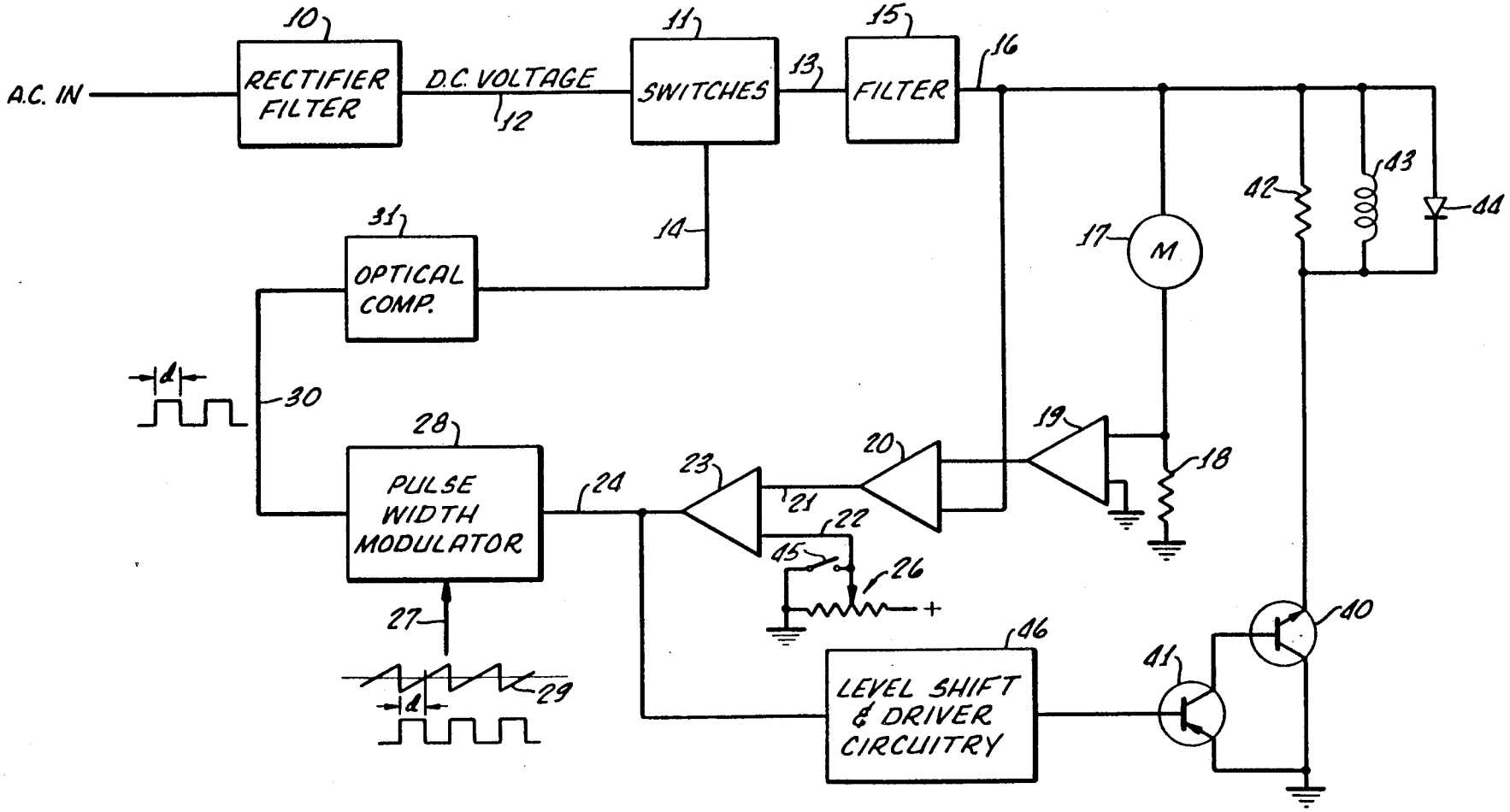
FIG. 2 shows a block diagram of the essential elements of the power control system.

Adverting to the drawings, and particularly FIG. 2, a preferred embodiment of the control system comprises a rectifier and filter 10 which converts the 110 volt cps input power to a DC voltage, an electronic switching device 11 which is triggered by a gating signal on line 14 so as to cause the impedance between the main terminals 12 and 13 to rapidly change from a high impedance "off" state to a low impedance "on" state and vice versa, and a low pass filter 15 which smooths out the rectangular waveform at 13 to provide a DC potential at 16 which is proportional to the average value of the rectangular waveform at 13. The output 16 is applied directly to a DC motor 17 which has its armature connected in series to ground through 0.02 ohm current sensing resistor 18. The output from amplifier 19 and the motor voltage is algebraically summed in amplifier 20 to provide a true back emf signal. This voltage is directly proportional to the motor velocity—and is therefore the equivalent of a tach feedback. Reference 22 provides the other input to amplifier 23—it being a DC voltage which is appropriately scaled to the desired speed of the belt 25 shown in FIG. 1. When the speed control 26 is rotated to the right the reference voltage on 22 increases causing the output 24 of the amplifier 23 to increase.

Pulse width modulator 28 functions to vary the duration of the gating signal applied to the electronic switching element 11. Input 27 to the pulse width modulator is a sawtooth waveform 29. The start of the rectangular gating pulse at 30 occurs at the beginning of each sawtooth and the duration "d" of the gating pulse output 30 is determined by the level of the DC input voltage at 24. Thus, when the amplitude of the sawtooth voltage 29 equals the value of the DC voltage at 24, a comparison circuit within the pulse width modulator 28 terminates the width of the gating pulse 30—thus causing the electronic switching element 11 to change from the conducting state to the non-conducting state. Optical coupler 31 functions to shift the level of the output 30 so as to provide an appropriate gating signal 14 for electronic switching element 11.

In summary, the back emf from the DC motor 14 is amplified and utilized to generate a power pulse having a duration which is proportional to the difference between the desired and actual speed of the belt 25. Because the system is operated by Dc, the problems experienced with prior art AC switching systems employing induction motors is eliminated. The motor operates with an efficiency of approximately 80% at all speeds, and high current short duration power pulses are nonexistent.

A further advantage of the present invention lies in the emergency braking circuitry. Referring again to FIG. 2, there is shown a npn-pnp transistor pair 40 and 41 respectfully which are series connected to a parallel network comprising a 10 ohm resistor 42, a choke 43, and a diode 44. When the emergency stop switch 45 is closed, the output voltage 24 reduces the pulse width "d" to zero so that the electronic switch 11 remains in the high impedance "off" state. The output level at 24 is also applied via the level shift and drive circuitry 46 to the base of transistor 41 which in turn causes the emitter of transmitter 40 to approach ground potential. When this occurs the motor 17 functions as a generator, and the voltage produced by the motor generator action will approach 140 volts. During the transistion period (i.e., the time required for transistor 40 to switch to full conduction) the current is limited to approximately 14 amps because of the 10 ohm resistor 42. The time required to saturate choke 43 is approximately 2 millisec, at which time the maximum current will approach 70 amps. The high reverse current flowing through the armature and the low external DC impedance comprising the choke 43 and transistor 40 provide a counter emf force which rapidly brakes the motor bringing it to an abrupt stop.

Referring to FIG. 1, a further advantage of the present invention lies in the belt buffering arrangement comprising flywheels 50 and 51. Flywheel 50 is attached to one end of the cylindrical belt roller 53 and flywheel 51 is attached directly to the output shaft of the DC motor 17. Impulse shocks delivered to the drive belt 54 by the action of the runner on belt 25 are thus attenuated in proportion to the ratio of the diameter of the cylindrical belt roller 53 to the flywheel 50. An additional advantage of the dual flywheel arrangement lies in the increased inertia reflected to the belt 25—the effective total inertia being equal to the inertia of flywheel 50 plus the inertial of flywheel 51 times the square of the quantity formed by the ratio of the diameter of the flywheel 50 to the diameter of the pulley wheel 55. The double flywheel configuration thus reduces belt slippage between 54 and 50 and the reflected inertia thus absorbs and buffers the motor 17 from the high impulse forces imparted to the belt 25.

Although the concepts of the invention have been illustrated in connection with a particular embodiment, the invention is not limited thereto, and it will be understood that numerous changes, modifications, and substitutes may be made without departing from the spirit of the invention.

What is claimed is:

1. A treadmill for diagnostic and therapeutic purposes comprising:

an endless belt supported at each end by a cylindrical roller;

a DC motor;

a DC reference voltage;

velocity sensing means responsively coupled to said DC motor for generating a voltage which is proportional to the angular speed of said DC motor;

pulse width control means responsively connected to said velocity sensing means for generating a gating pulse having a duration which is proportional to the difference between the voltage generated by said velocity sensing means and said reference voltage;

means for coupling said DC motor to said endless belt;

power supply means for converting a standard 110 volt 60 cps household power to a unidirectional potential;

switching means having its main terminals series connected between said DC motor and the output of said power supply means and its gating terminal responsively connected to said pulse width control means, for controlling the duration of the DC voltage applied to said DC motor in response to the width of the pulses generated by said pulse width control means at least one semiconductor switching device;

a choke means having a low DC resistance;

a resistor connected in parallel with said choke means;

means for connecting said switching device in series with the parallel combination of said resistor and said choke means, and;

means for connecting the network comprised of said semiconductor switching device and said choke means and said resistor in parallel with said DC motor, and;

means for actuating said switching device so as to cause said switching device to short circuit said choke means and resistor network across the terminals of said DC motor.

2. The apparatus recited in claim 1 wherein said means for coupling said DC motor to said endless belt comprises:

a first flywheel attached to one of the support rollers of said endless belt, said flywheel having a diameter larger than the diameter of the support roller;

a second flywheel attached to the output shaft of said DC motor, said second flywheel having an attached drive wheel having a diameter smaller than the diameter of said second flywheel;

a drive belt connecting the outside diameter of said first flywheel to said drive wheel of said second flywheel.

3. In a treadmill of the type employing a variable speed drive, the improvement which comprises:

a DC motor;

a DC power supply;

switching means connected between said DC power supply and said DC motor, and having a control terminal and a pair of main terminals for chopping the output of said DC power supply so as to generate a succession of equal amplitude pulses for operating said DC motor;

control means for generating a reference voltage which is proportional to the desired angular motor velocity;

detector means for generating a voltage which is proportional to the actual angular velocity of said DC motor;

gating means responsively connected to said detector means and said control means for generating a signal having a duration which is proportional to the difference between the magnitude of the voltage produced by said control means and said detector means;

said gating means comprises a pulse width modulator and further including;

means for generating a sawtooth voltage;

comparison means for detecting when the amplitude of the sawtooth voltage reaches a predetermined level which is functionally dependent upon the difference between the magnitude of the output generated by said control means and the magnitude of the potential generated by said detector means;

means for generating a pulse having a time width equal to the time required for the sawtooth voltage to rise from a predetermined base value to the potential required to actuate said comparison means;

coupling means operatively connected between the output of said gating means and the input to the control terminal of said switching means for applying the gating signal generated by said gating means to the control terminal of said switching means so as to cause the duration of the DC pulses applied to said DC motor to increase in proportion to the difference between the magnitude of the voltage generated by said control means and the voltage generated by said detector means.

4. The apparatus recited in claim 3 wherein the output shaft of said DC motor is coupled to a drive roller which propels the belt of said treadmill, and wherein said coupling comprises:

a first flywheel attached to the output shaft of said DC motor;

a second flywheel attached to said drive roller;

a flat pulley band connecting said first flywheel to said second flywheel.

5. The apparatus recited in claim 4 wherein said flat pulley band is connected between said first and second flywheels so as to cause said second flywheel to rotate at a lower angular velocity than said first flywheel.

6. The apparatus recited in claim 3 wherein is included:

means for short circuiting the terminals of said DC motor and;

means for disabling said gating means when the terminals of said DC motor are short circuited whereby the width of the pulses applied to said DC motor will be reduced to zero.

7. The apparatus recited in claim 3 wherein said detector means comprises:

voltage measuring means for measuring the voltage across said DC motor;

current measuring means for measuring the current flowing in the armature of said DC motor;

differencing means responsively connected to said voltage sensing means and said current sensing means for generating a voltage which is functionally dependent upon the back emf of said DC motor.

8. The apparatus recited in claim 7 wherein said differencing means comprises an amplifier having one input connected to a resistor connected in series with said DC motor and the other input connected across the combination comprised of said motor and said resistor.

* * * * *